US011150049B2

(12) United States Patent
Kennair, Jr.

(10) Patent No.: US 11,150,049 B2
(45) Date of Patent: Oct. 19, 2021

(54) TACTICAL-GEAR-RAILS CONNECTOR-ADAPTER SYSTEM APPARATUS AND METHOD

(71) Applicant: Donald Kennair, Jr., Belle Chasse, LA (US)

(72) Inventor: Donald Kennair, Jr., Belle Chasse, LA (US)

( * ) Notice: Subject to any disclaimer, the term of this patent is extended or adjusted under 35 U.S.C. 154(b) by 0 days.

(21) Appl. No.: 16/901,323

(22) Filed: Jun. 15, 2020

(65) Prior Publication Data

US 2020/0333104 A1 Oct. 22, 2020

Related U.S. Application Data

(62) Division of application No. 15/059,451, filed on Mar. 3, 2016, now Pat. No. 10,684,092.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)

(58) Field of Classification Search
None
See application file for complete search history.

(56) References Cited

U.S. PATENT DOCUMENTS 5,941,489 A 8/1999 Fanelli et al.
8,371,056 B1 2/2013 Baker et al.
9,738,352 B1 8/2017 Zook
2010/0107467 A1 5/2010 Samson et al.
2012/0144717 A1 6/2012 Peterson et al.
2012/0285067 A1 11/2012 Kitzen
2012/0311909 A1 12/2012 Cheng
2014/0096429 A1* 4/2014 Sandler ..... F41G 11/003 42/124
2014/0130390 A1* 5/2014 Geissele ..... F41C 23/16 42/71.01
2014/0157644 A1 6/2014 Jiminez et al.
2014/0190062 A1 7/2014 Turner, Jr. et al.
2014/0252187 A1 9/2014 Petrovic
2014/0259854 A1* 9/2014 Williams ..... F41G 11/003 42/124
2015/0040456 A1 2/2015 Zimmer
2015/0316355 A1 11/2015 Boswell
2017/0241735 A1 8/2017 Burge
2018/0283826 A1* 10/2018 Alldredge ..... F41G 11/003

FOREIGN PATENT DOCUMENTS

WO WO2013040638 A1 3/2013

* cited by examiner

*Primary Examiner* — J. Woodrow Eldred
(74) *Attorney, Agent, or Firm* — Keaty Law Firm LLC

(57) ABSTRACT

A tactical-gear-rail connector-adapter system apparatus and method utilizing the Picatinny-rail standard, allowing precise aligned removable interconnection of a variety of tactical gear or auxiliary equipment such as telescopic sights, night vision devices, reflex sights, laser aiming modules, rangefinders, tactical lights, cameras, fore-grips, bipods, and bayonets, in field-interchangeable configurations, to small-arms rifles and pistols and to non-firearm tactical gear, by providing a greater amount of interconnection options.

2 Claims, 10 Drawing Sheets

TACTICAL-GEAR-RAILS CONNECTOR-ADAPTER SYSTEM APPARATUS AND METHOD

CROSS-REFERENCE TO RELATED APPLICATIONS

This application is a divisional application of my application Ser. No. 15/059,451, filed on Mar. 3, 2016, now U.S. Pat. No. 10,684,092, issued on Jun. 16, 2020, the full disclosure of which is incorporated by reference herein and priority of which is hereby claimed.

BACKGROUND OF THE INVENTION

The present invention provides a tactical-gear-rail connector-adapter system apparatus and method allowing interconnection of a variety of tactical gear or auxiliary equipment such as gun stocks, camera supports, sights and rangefinders, grips, and clamps, in field-interchangeable configurations.

The Weaver rail mount was a small-arms manufacturer's apparatus to facilitate the removable mounting of telescopic sights on rifles while ensuring proper alignment. With some modifications, the Weaver rail was adopted as a U.S. military standard, the MIL-STD-1913 rail, also known as Picatinny rail, Standardization Agreement (STANAG) 2324 rail, or tactical rail. The NATO Accessory Rail (NAR), also known as Standardization Agreement (STANAG) 4694 rail, is another, very closely related and essentially interchangeable standard, using essentially the same dimensions stated in metric units.

The Picatinny rail provides a standard mounting platform for small arms—rifles and pistols—and consists of rails with angled surfaces for alignment and attachment, and regularly spaced transverse slots allowing screws, bolts, or other connectors to pass underneath the object being mounted. Use of the Picatinny rail is no longer limited to telescopic sights, but also includes mounting auxiliary equipment such as night vision devices, reflex sights, laser aiming modules, tactical lights, cameras, fore-grips, bipods, and bayonets to small arms in both military and non-military uses.

A large and growing amount of auxiliary equipment using the Picatinny-rail system now exists. Just one continuous unit of Picatinny rail is unlikely to be adequate to properly mount all of the auxiliary equipment, because of a lack of total mounting area and because in-line mounting causes some equipment to be ahead or behind other equipment along the line of fire. Even where equipment can be fit onto a single rail by clever arrangement, that clever arrangement is likely to cause complications if any reconfiguration is later needed in the field. Also, some auxiliary equipment is better mounted at some angle to the line of fire.

In some circumstances, only the auxiliary equipment is needed, without any rifle or pistol, such as with cameras, spotting scopes, rangefinders, remotely located equipment, and decoy equipment. Also, in some circumstances, it is not possible or proper to point a firearm toward an object of interest just for the sake of getting a photograph, measurement, or reading. In such circumstances, mounting to Picatinny rails that are not attached to a firearm, but that still provide the properly aligned mounting surfaces, and still allow for the use of stocks, grips, bipods, and the like, is desirable.

The Picatinny rail standard provides for rail-runs of the actual rails and rail-grabbers which are clamps or receivers of proper size and configuration that can be tightened or clamped down on a rail-run. Any given piece of tactical gear or auxiliary equipment generally has either a rail-run or a rail-grabber provided, but not both. Therefore, a problem is encountered when, for example, it is found in the field to be necessary to interconnect two pieces both having only rail-runs or both having only rail-grabbers.

Another problem encountered in the field is a lack of clearance to mount one piece to another, even where the proper rail-run and rail-grabber are present. For example, something else might already be mounted and taking up space, extending well past its rail-grabber section and preventing the mounting of a second piece.

There is a need for a rail-mounting connector-adapter system, utilizing the Picatinny-rail standard, that provides a greater amount of mounting options for small-arms and non-firearm tactical gear auxiliary equipment.

SUMMARY OF THE INVENTION

The present invention is a tactical-gear-rail connector-adapter system apparatus and method utilizing the Picatinny-rail standard, allowing precise aligned removable mounting of a variety of tactical gear auxiliary equipment such as telescopic sights, night vision devices, reflex sights, laser aiming modules, rangefinders, tactical lights, cameras, fore-grips, bipods, and bayonets, in field-interchangeable configurations, to small-arms rifles and pistols and to non-firearm tactical gear, by providing a greater amount of mounting options.

This invention solves a problem with precise aligned removable interconnection of a growing amount of auxiliary equipment and tactical gear, under field conditions.

BRIEF DESCRIPTION OF DRAWINGS

Reference will now be made to the drawings, wherein like parts are designated by like numerals, and wherein.

DETAILED DESCRIPTION OF THE INVENTION

Figure 1:
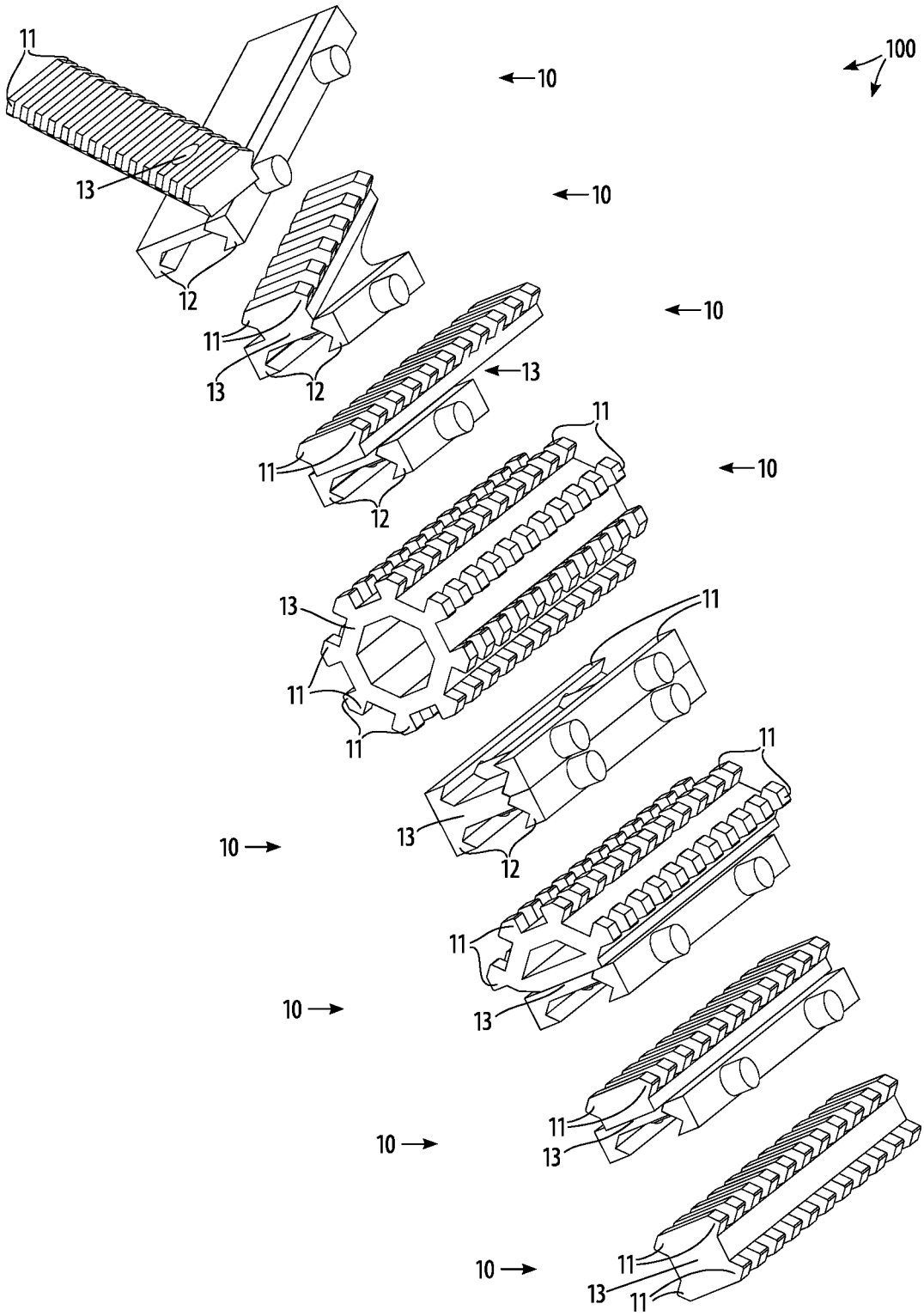
FIG. 1 is an orthographic vies of embodiments of the tactical-gear-rail connector-adapter system.

Referring to FIG. 1 and the other figures generally, several embodiments of the tactical-gear-rail connector-adapter system method 100 and apparatus 10 are shown. The Picatinny rail standard defines the dimensions of a rail-run which is a length of rail with a top surface, bilaterally symmetrical angled side surfaces, a clearance underneath the side surfaces, and a regular series of transverse slots to accommodate one or more transverse connectors. The standard implicitly defines the dimensions of a rail-grabber, which is a clamp fitting over a section of rail-run capable of being tightened and fixed against the rail-run using one or more transverse connector. The tightening of the rail-grabber in a perpendicular direction across and essentially in the same plane as the rail-run prevents the rail-grabber from skewing or camming in relation to the rail-run, and, as a result, whatever auxiliary equipment is fixed to the rail-grabber will be held in proper alignment with whatever tactical gear is fixed to the rail-run.

This invention provides a system of connector-adapters to allow expanded options for interconnecting tactical gear and auxiliary equipment having either a rail-run or a rail-grabber, especially in the field with limited ability to make modifications to whatever rail component might be permanently or semi-permanently fixed to the gear or equipment. As shown, the invention can make a rail-run-to-rail-run or rail-grabber-to-rail-grabber interconnection, a stand-off or offset interconnection for the purpose of gaining enough clearance to make the connection, an interconnection that is angled in relation to different axes, and a one-to-many interconnection.

Figure 2:
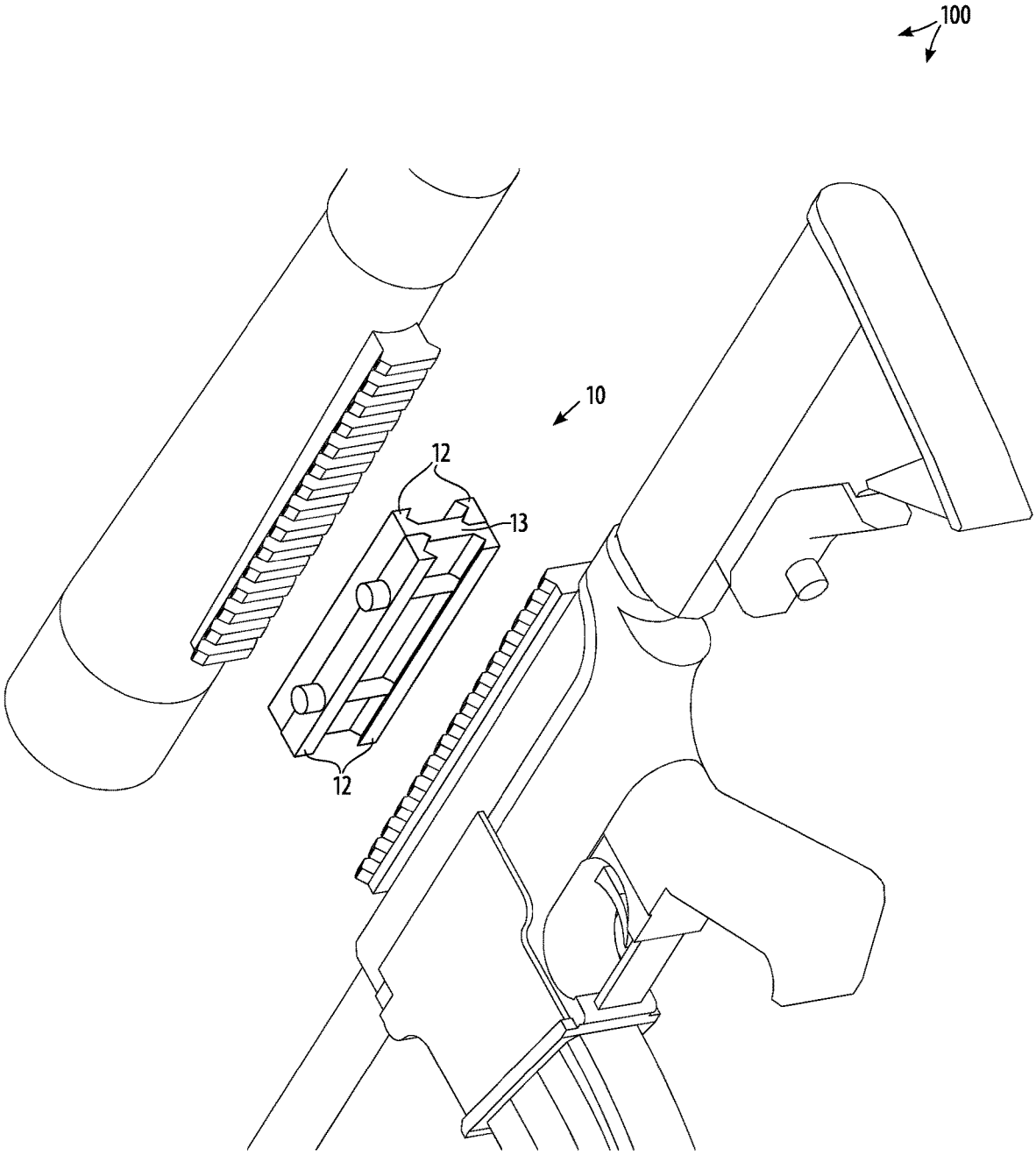
FIG. 2 is a schematic view of an embodiment of the tactical-gear-rail connector-adapter system in use.

Referring briefly to FIG. 2, an embodiment of the tactical-gear-rail connector-adapter system is schematically shown connecting a rail-run-equipped scope to a rail-run-equipped rifle, where the connection would not otherwise be possible under field conditions.

Figure 3:
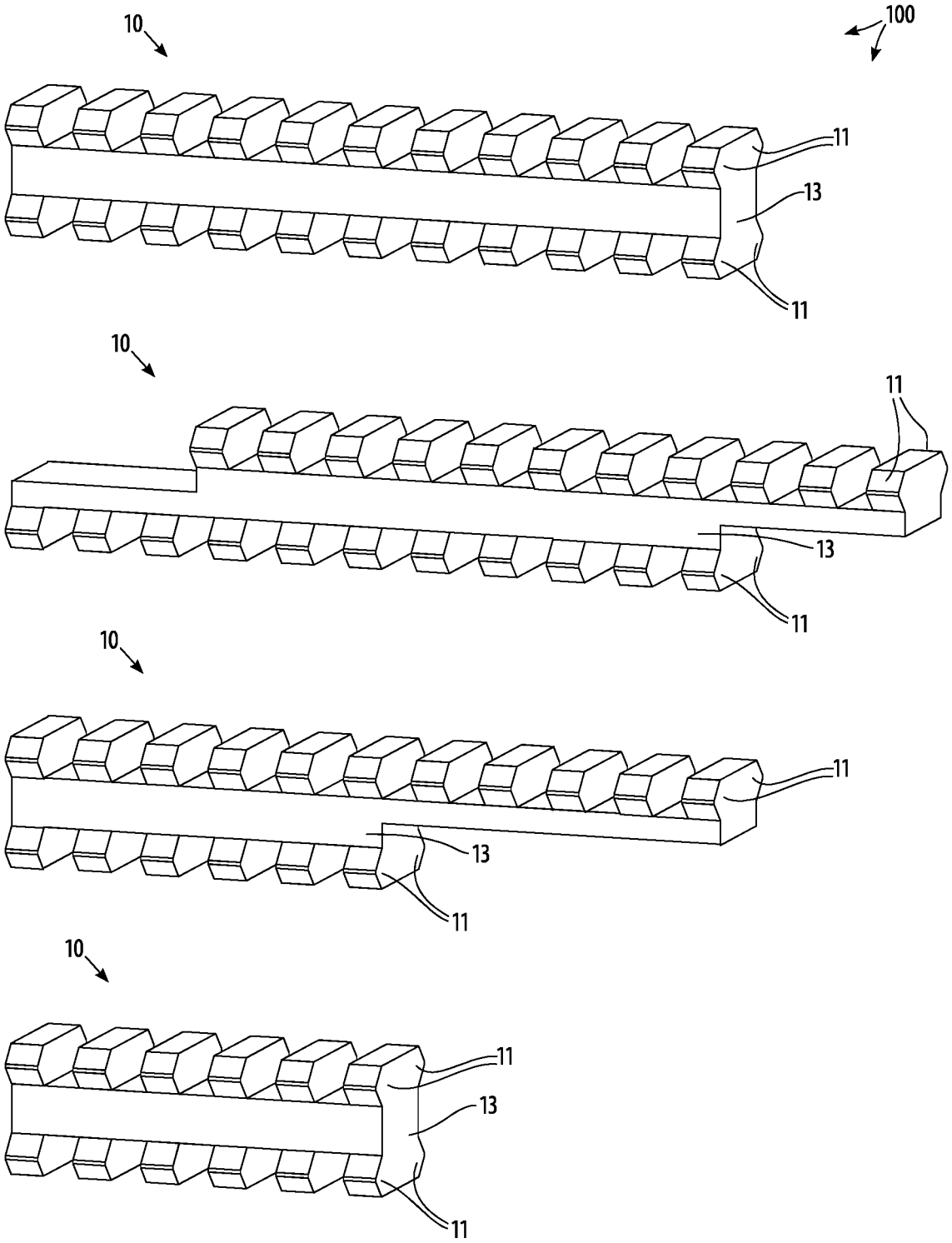
FIG. 3 is an orthographic view of embodiments of the tactical-gear-rail connector-adapter system.
Figure 4:
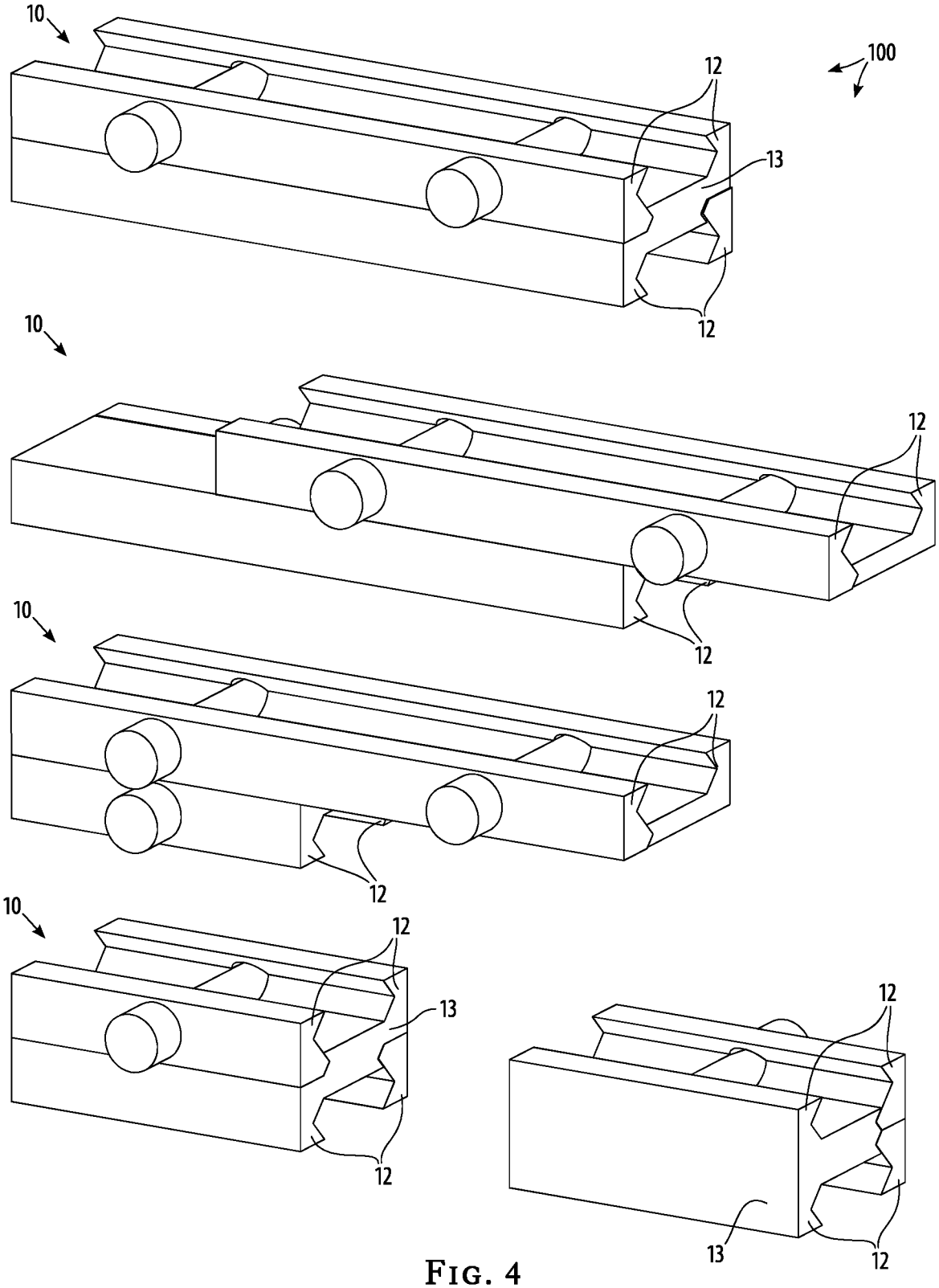
FIG. 4 is an orthographic view of embodiments of the tactical-gear-rail connector-adapter system.

The tactical-gear-rail connector-adapter system apparatus 10 has a connector body 13 to which is attached more than one rail-connector unit, each of which can be either a rail-run section 11 or a rail-grabber section 12. The embodiments of FIG. 2 & FIG. 4 have two rail-grabber sections 12, suitable for connecting a rail-run to another rail-run. The embodiments of FIG. 3 have two rail-run sections 11, suitable for connecting a rail-grabber to another rail-grabber. In addition to providing such like-to-like connections, the invention can also provide an offset mounting surface or a larger or smaller mounting surface where needed.

Figure 5:
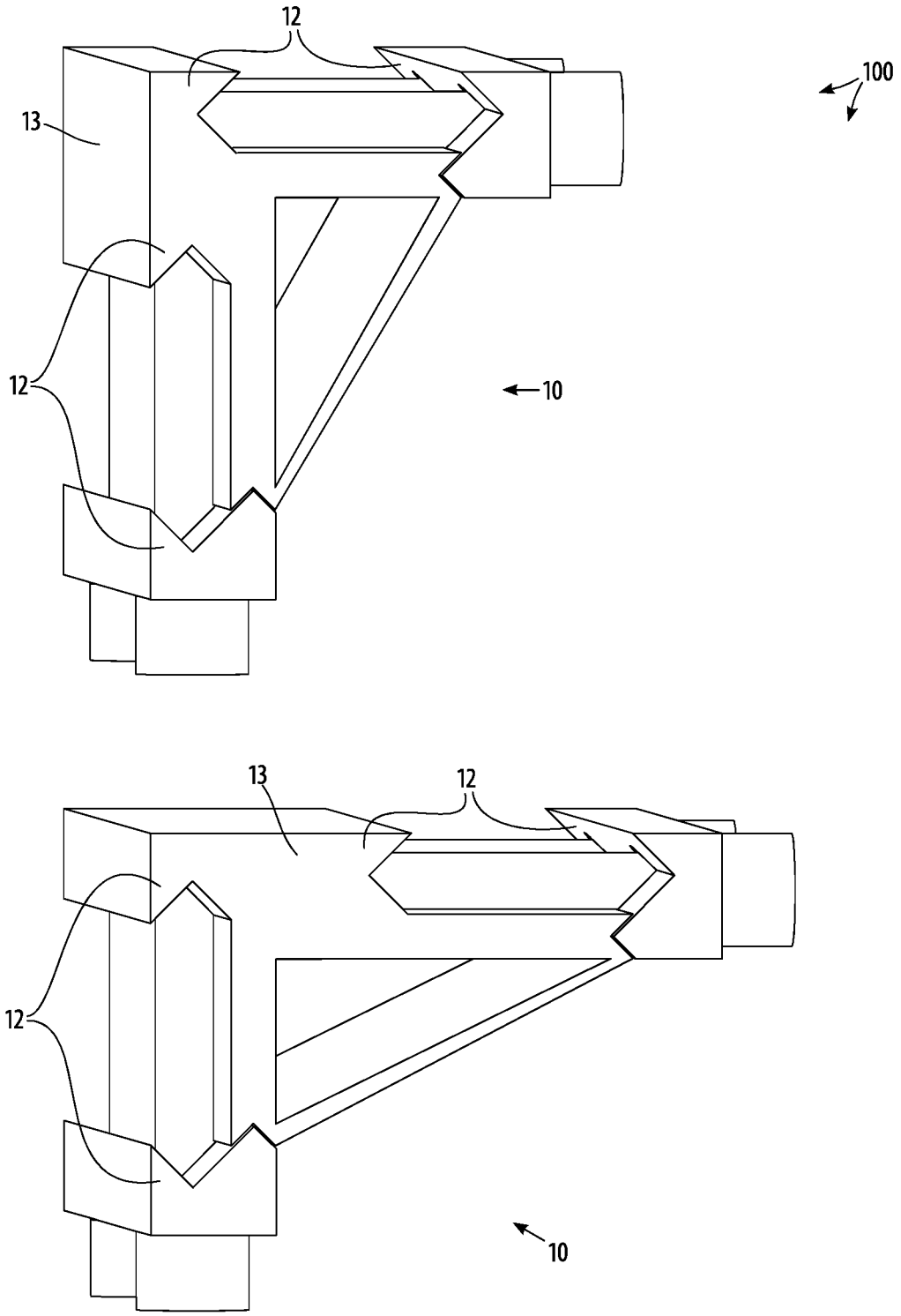
FIG. 5 is an orthographic view of embodiments of the tactical-gear-rail connector-adapter system.

Referring now to FIG. 5, embodiments providing rail-grabbers 12 at right angles to each other are shown. Such an embodiment would be useful to, for example, mount a camera off to the side of a rifle where each would not interfere with the other. As shown, sufficient clearance for a wide camera or other auxiliary equipment can be provided.

Figure 6:
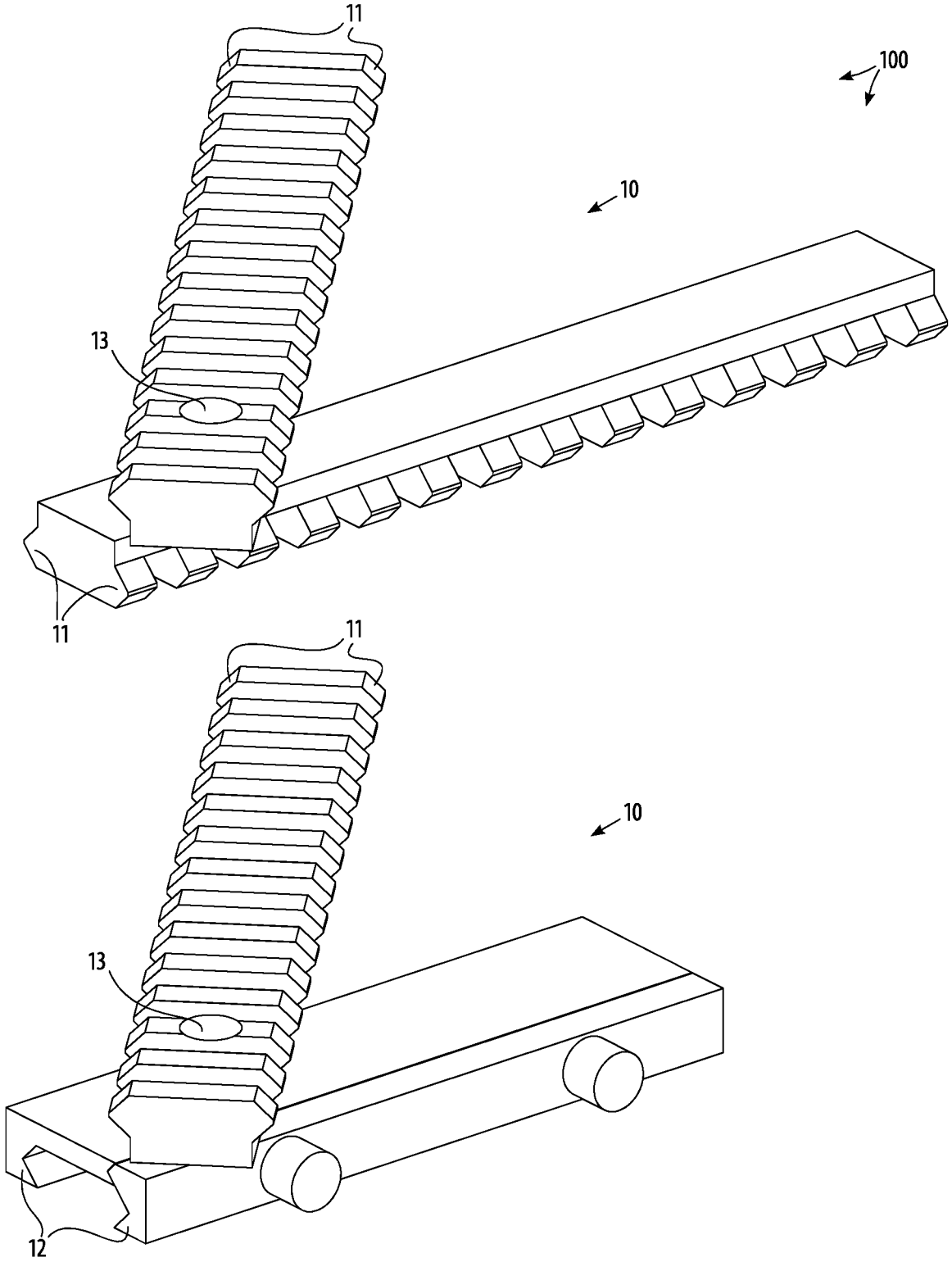
FIG. 6 is an orthographic view of embodiments of the tactical-gear-rail connector-adapter system.

Referring to FIG. 6, embodiments providing mounting at an angle to the principal axis are shown. In these embodiments, the connector body 13 is essentially a pivot pin or other pivoting, fixable connection.

Figure 7:
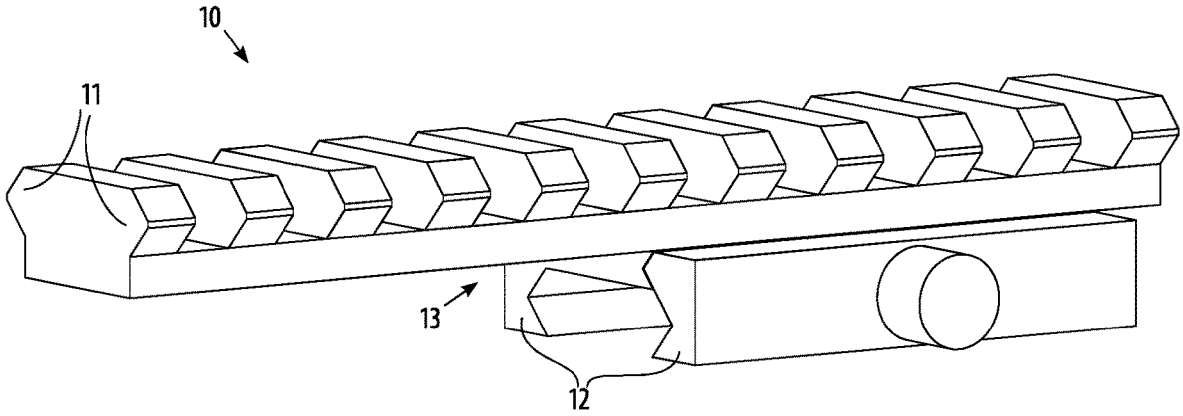
FIG. 7 is an orthographic view of an embodiment of the tactical-gear-rail connector-adapter system.

Referring to FIG. 7, an embodiment with a shorter rail-grabber section 12 and a longer rail-run section 11 is shown. In use, when attached to an existing rail-run, this embodiment provides a raised and extended available mounting surface.

Figure 8:
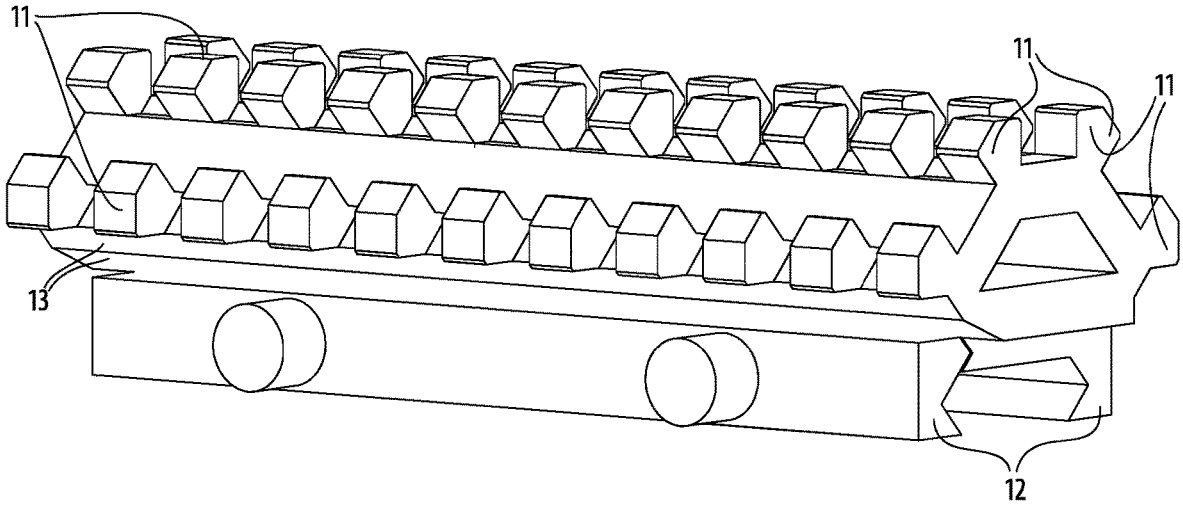
FIG. 8 is an orthographic view of an embodiment of the tactical-gear-rail connector-adapter system.

Referring to FIG. 8, an embodiment with one rail-grabber section 12 and three rail-run sections 11 is shown. One rail-run section is oriented on the same plane as the rail-grabber section, and the other two are oriented at angles on the principal axis.

Figure 9:
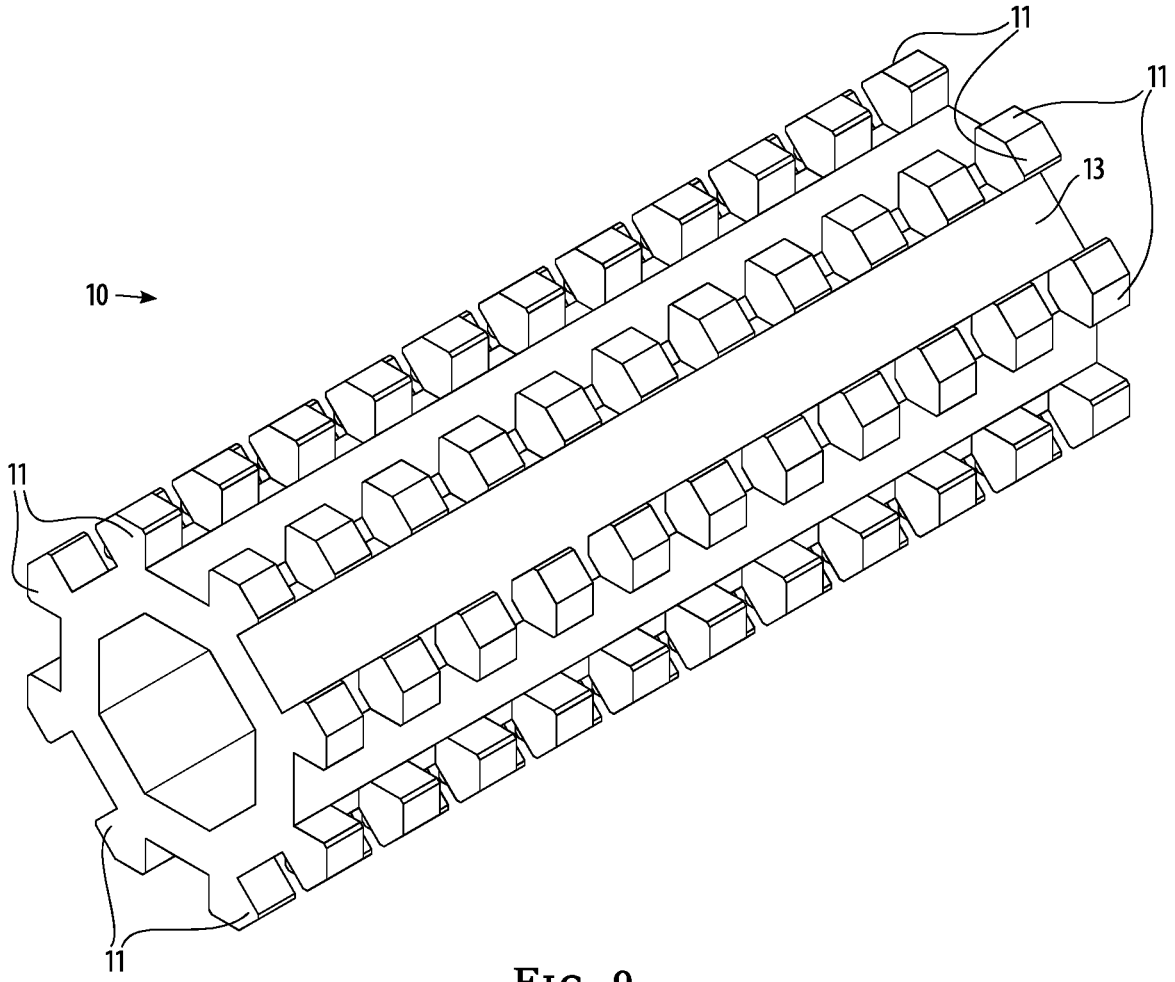
FIG. 9 is an orthographic view of an embodiment of the tactical-gear-rail connector-adapter system.
Figure 10:
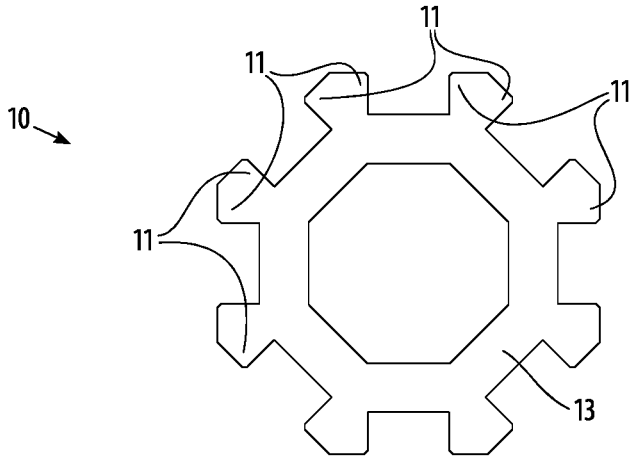
FIG. 10 is a side view of an embodiment of the tactical-gear-rail connector-adapter system.

Referring to FIG. 9 & FIG. 10, an embodiment with eight rail-run sections 11 is shown. The rail-run sections are fixed at various angles to each other on the principal axis. Such an embodiment provides many options for mounting several pieces or for mounting at different angles on the principal axis.

Figure 11:
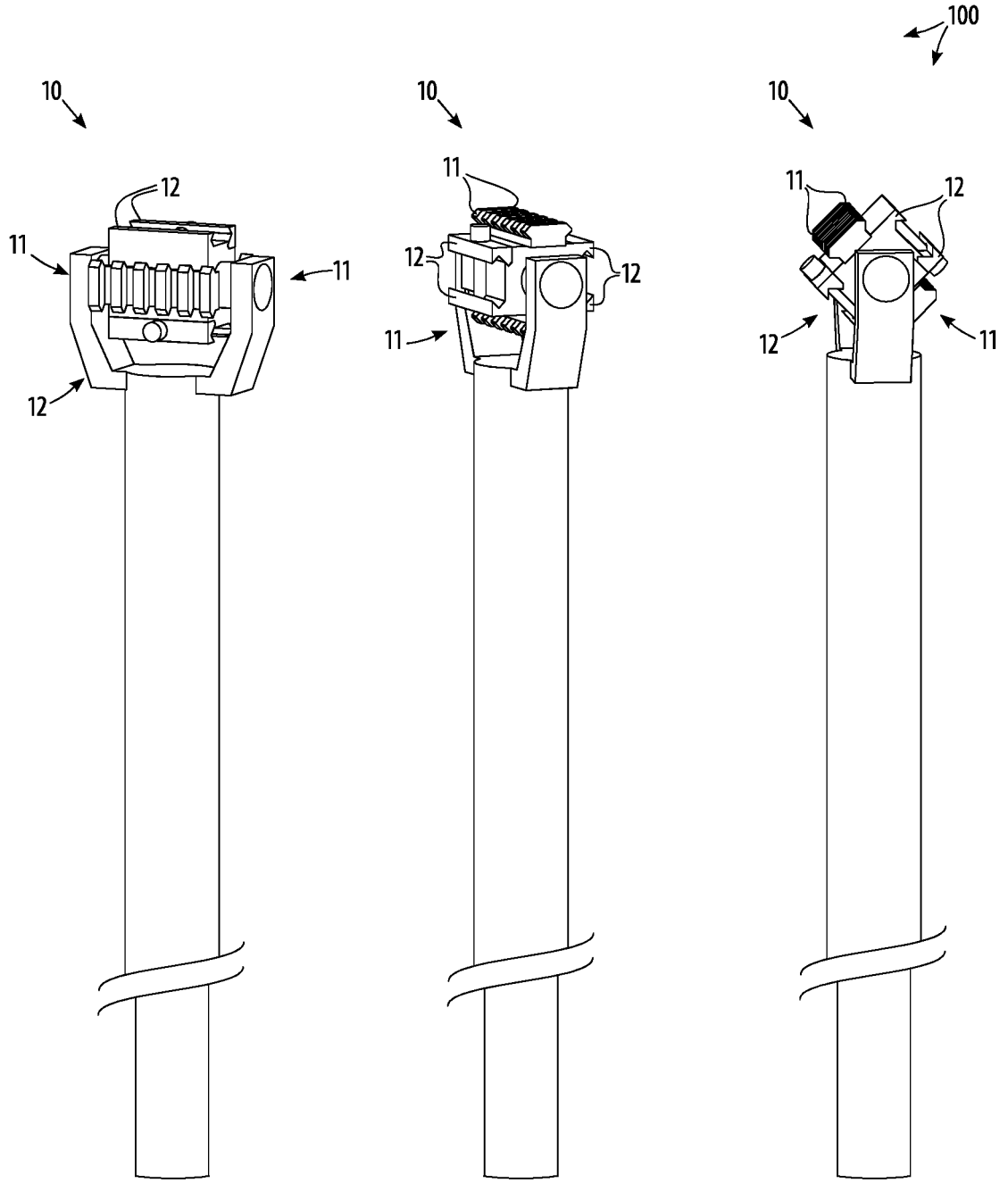
FIG. 11 is an orthographic view of an embodiment of the tactical-gear-rail connector-adapter system.
Figure 12:
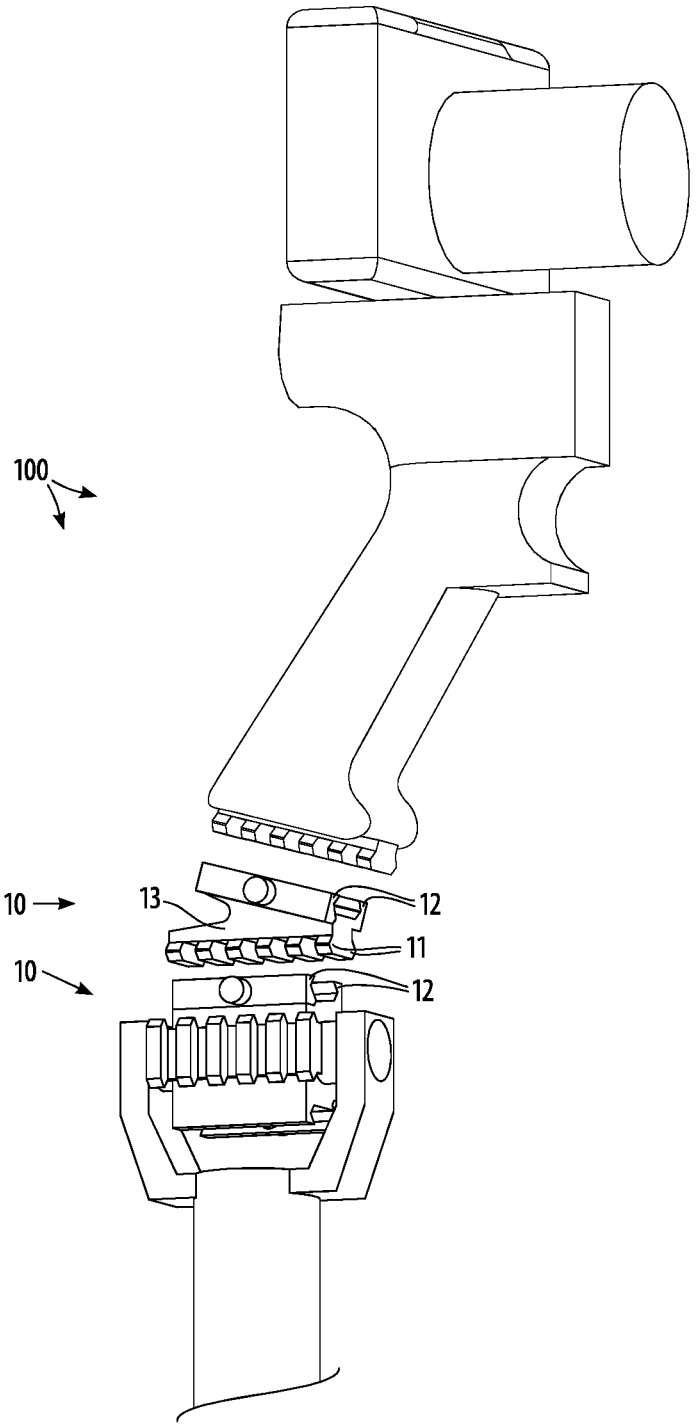
FIG. 12 is a schematic view an embodiment of the tactical-gear-rail connector-adapter system in use.

Referring to FIG. 11, an embodiment is shown attached to the head of a monopod stabilizing device. This embodiment has two rail-run sections 11 and two rail-grabber sections 12 all running on a common principal axis, at right angles to each other on that axis. FIG. 12 schematically shows this embodiment in use, stabilizing a camera and grip.

Suitable materials for making the tactical-gear-rail connector-adapter system apparatus 10 are essentially the same range of materials used to manufacture tactical gear, which is machinable metals, composite materials, and hard plastics. Different components can be made of different materials. If it is desired to make an electrically conductive connection between two conductive pieces of gear, then electrically conductive material should be used. On the other hand, pieces of gear can be electrically isolated from each other with a tactical-gear-rail connector-adapter system apparatus 10 constructed of non-conductive material.

The simplicity and interchangeability of the tactical-gear-rail connector-adapter system provides benefits in the field. Auxiliary equipment can be swapped among or be borrowed from other gear. Connection and disconnection can be accomplished blindfolded in training and under challenging conditions in the field. Unusual configurations of auxiliary equipment tactical gear can be made in the field, without tools, in order to meet unusual circumstances.

Many changes and modifications can be made in the present invention without departing from the spirit thereof. I therefore pray that my rights to the present invention be limited only by the scope of the appended claims.

I claim:

1. A tactical-gear-rail connector-adapter system apparatus for precise aligned removable interconnection of a variety of tactical-gear and auxiliary equipment having rail-runs of Picatinny rail comprising:

(i) a connector body having a fixed linear longitudinal axis and a nominal top surface and a bottom surface, all parallel; and (ii) a pair of rail-run sections arrayed upon said connector body, one upon the top surface and one upon the bottom surface, both along the fixed linear longitudinal axis;

where said rail-run sections arrayed upon said connector body provide connection areas in fixed parallel relationship one to the other and forming an extendable available mounting surface; and where the extended available mounting surface is thus provided for precise aligned removable interconnection of tactical-gear and auxiliary equipment.

2. A tactical-gear-rail connector-adapter system method for precise aligned removable interconnection of a variety of tactical-gear and auxiliary equipment having rail-runs of Picatinny rail comprising:

(i) providing a tactical-gear-rail connector-adapter system apparatus, comprising:

(a) a connector body having a fixed linear longitudinal axis and a nominal top surface and a bottom surface, all parallel; and (b) a pair of rail-run sections arrayed upon said connector body, one upon the top surface and one upon the bottom surface, both along the fixed linear longitudinal axis;

where said rail-run sections arrayed upon said connector body provide connection areas in fixed parallel relationship one to the other and forming an extendable available mounting surface; and where the extended available mounting surface is thus provided for precise aligned removable interconnection of tactical-gear and auxiliary equipment; and (ii) using said tactical-gear-rail connector-adapter system apparatus for precise aligned removable mounting of a variety of tactical-gear auxiliary equipment.

* * * * *